United States Patent [19]

Silva et al.

[11] 4,331,310

[45] May 25, 1982

[54] REFUSE CONTAINER SUPPORTING APPARATUS

[76] Inventors: Wilbur W. Silva, 704 Creek View Ct., Modesto, Calif. 95351; Victor K. Zlab, 4833 Berkeley Ave., Hughson, Calif. 95326

[21] Appl. No.: 171,975

[22] Filed: Jul. 24, 1980

[51] Int. Cl.[3] ..... A47G 23/02

[52] U.S. Cl. ..... 248/146; 211/84; 248/DIG. 7

[58] Field of Search ..... 248/146, 147, 153, 154, 248/302, DIG. 7; 211/71, 82, 83, 84; 220/18, 85 CH, 244

[56] References Cited

U.S. PATENT DOCUMENTS

| | | | |
|---|---|---|---|
| 1,348,807 | 8/1920 | Kivlan | 248/153 |
| 2,411,864 | 12/1946 | Birkin | 248/302 X |
| 2,678,184 | 5/1954 | Erdody | 248/302 X |
| 2,808,173 | 10/1957 | Patnode | 220/18 |
| 3,399,854 | 9/1968 | Patterson | 211/81 |
| 3,463,429 | 8/1969 | Novak | 211/83 X |
| 3,527,356 | 9/1970 | Herdy | 211/82 |
| 3,547,273 | 12/1970 | Bompart | 211/84 |

FOREIGN PATENT DOCUMENTS

| | | | |
|---|---|---|---|
| 210099 | 7/1960 | German Democratic Rep. | 248/153 |

*Primary Examiner*—J. Franklin Foss
*Attorney, Agent, or Firm*—Thomas H. Olson

[57] ABSTRACT

Supporting apparatus for a refuse container and the lid for such container. The apparatus includes a bracket mountable on an upright and a support pivotally mounted to the bracket between a lower generally horizontal position and an upper generally vertical position. The support has portions which confine the container against lateral movement and portions which rest on the lid when the support is in the horizontal position so as to prevent access to the container by dogs and the like.

8 Claims, 5 Drawing Figures

REFUSE CONTAINER SUPPORTING APPARATUS

BACKGROUND OF THE INVENTION

1. Field of the Invention

This invention relates to supporting apparatus for a refuse container which apparatus both circumscribes the container and retains the lid thereon to prevent access to or tipping of the container by dogs and the like.

2. Description of the Prior Art

The following U.S. patents disclose garbage can holders which are permanently fastened to the lid of the garbage can: U.S. Pat. Nos. 2,808,173; 3,463,429; and 3,547,273. The following U.S. patents disclose garbage can holders that have a lower can supporting member and an upper lid engaging member: U.S. Pat. Nos. 2,409,326 and 3,128,981.

SUMMARY OF THE INVENTION

According to the present invention there is a unitary can support member and a bracket for pivotally mounting the support member to an upright. The support member is configured to perform the dual functions of supporting the can so that it cannot be tipped over and of retaining the lid on the can so it cannot be inadvertently removed. Additionally, the can support member is constructed so that no attachment to the can or the lid or any other modifications to the refuse container are needed.

An object of the invention is to provide a refuse container supporting apparatus which prevents access to the container by dogs or like animals. This object is achieved because the apparatus has container engaging portions which support the can against lateral movement and lid retaining portions which retain the lid upon the container.

Another object of the invention is to provide refuse container supporting apparatus which is simple and inexpensive to manufacture and which can be installed at a variety of locations. This object is achieved because the can supporting portion of the apparatus is of unitary configuration having no moving parts and because the bracket to which the can support is pivotally joined can be bolted or otherwise affixed to an upright at any suitable location.

The foregoing together with other objects, features and advantages of the invention will be more apparent after referring to the following specification and the accompany drawing.

DETAIL DESCRIPTION OF THE PREFERRED EMBODIMENT

Figure 1:
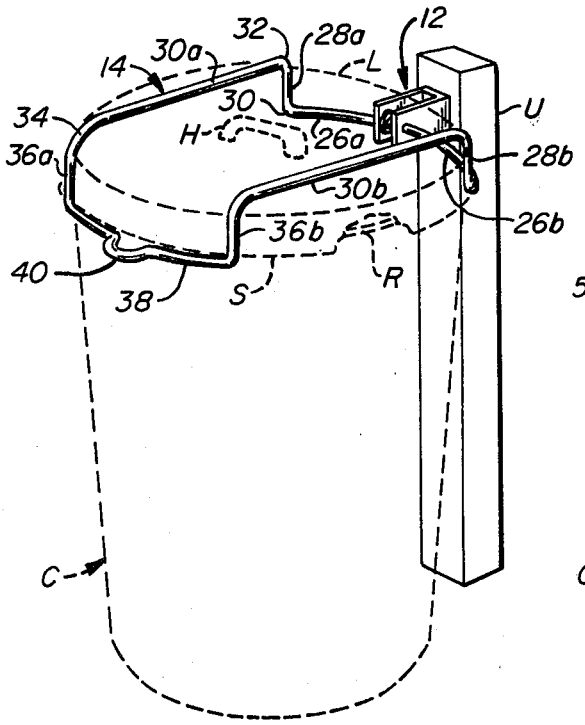
FIG. 1 is a perspective view of a refuse container supporting apparatus according to the invention.

Referring more particularly to the drawings, reference character C indicates a refuse container of conventional form. The container includes an impervious wall which terminates at its upper extremity at a rim R which defines an opening for affording access to the interior of the container. A lid L of conventional form is provided, the lid having a centrally disposed handle H and a skirt portion S which overlaps the upper margin of the wall that defines the container.

In FIG. 1, container C is shown adjacent an upright U which in the specific example is a post set into the ground. Such showing is exemplary because the upright can be in the form of a wall, a fence or any other like structure having a substantially vertical surface. The can support of the invention includes a bracket 12 installed on upright U at a level approximating that of rim R and a container support 14 which pivots between a horizontal container engaging position shown in solid lines in FIG. 2 and a vertical raised position shown in broken lines in FIG. 2.

Figure 5:
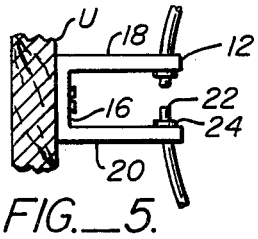
FIG. 5 is a fragmentary top view of a bracket forming a part of the invention.

Bracket 12, as seen in FIG. 5, is of generally U-shaped configuration having a base plate 16 adapted to be secured to upright U and two side legs 18 and 20 that extend perpendicularly outward from the base leg. The ends of side legs 18 and 20 remote from base leg 16 form aligned apertures through which extend the ends of container support member 14, one such end being identified at 22. There is a washer 24 which is secured to end 22 by swaging or otherwise enlarging the end to retain the washer in place and thus capture end 22 within bracket 12. Accordingly, bracket 12 constitutes means for supporting container support 14 for pivotal movement about a horizontal axis.

Can support 14 is formed of any suitable relatively thin rigid material such as cold rolled steel rod having a diameter of $\frac{3}{8}$ inches. Can support 14 includes two portions **26*a* and 26*b* which extend outward in opposite direction from bracket 12 and form a first container confining portion of support 14. The container confining portion defined by portions 26*a* and 26*b* has a shape in conformity with the shape of container C, an arcuate shape in the embodiment shown in the drawings. At the respective ends of the container confining portion formed by portions 26*a* and 26*b* are upstanding legs 28*a* and 28*b*. The legs are integral with portions 26*a* and 26*b* and the juncture between the legs and the portions is constituted by a bend such as indicated at 30. In one apparatus designed in accordance with the invention, legs 28*a* and 28*b* have a length of approximately four inches. Extending horizontally from the respective upper ends of legs 28*a* and 28*b* are lid retainers 30*a* and 30*b* which are integral with respective legs 28*a* and 28*a* and extend from the legs at bends such as indicated at 32. Lid retainers 30*a* and 30*b* extend chordally of an imaginary circle of which portions 26*a* and 26*b* are part. Thus the retainers rest on the upper surface of lid L when support 14 is in the horizontal position seen in FIG. 1**.

Lid retainers **30*a* and 30*b* terminate at bends 34 at which are vertical legs 36*a* and 36*b* which are parallel to and of the same vertical dimension as legs 28*a* and 28*b*. As can be seen most clearly in FIG. 1, lid retainer 30*a* forms with legs 28*a* and 36*a* an inverted U-shaped member as does lid retainer 30*b* with legs 28*b* and 36*b*. At the ends of legs 36*a* and 36*b* remote from respective led retainers 30*a* and 30*b* is a container confining portion 38 which has a curvature equivalent to that of the container confining portion formed by portions 26*a* and 26*b*. Centrally of container confining portion 38*a* is an outward extending handle 40** for affording a hand grip on the support to facilitate pivotal movement of the same.

Figure 2:
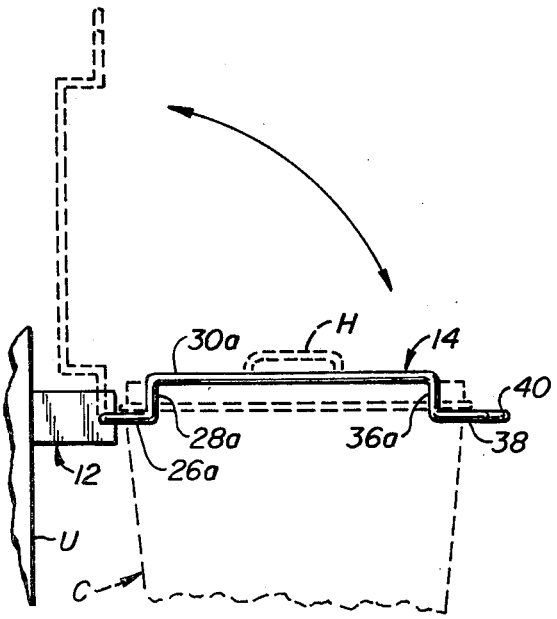
FIG. 2 is a side view of the apparatus of FIG. 1.

In operation bracket 12 is installed at an appropriate height on upright U. More particularly, the bracket is installed at a level such that when support 14 is in a horizontal position seen in FIG. 2, lid retainers 30*a* and 30*b* lie in a horizontal position along the upper surface of lid L. Container C is then moved into position and support 14 is lowered by grasping handle 40 and pivoting the support downward to the position seen in FIG. 2. In such position the container confining portions 26*a*, 26*b* and 38 inhibit lateral movement of container C. Also in such position lid retainers 30*a* and 30*b* rest on the upper surface of lid L and prevent removal of the lid. Because of the weight of support 14, the support is gravitationally biased into the engaged or horizontal position. When access to the interior of container C is desired, handle 40 is grasped and support 14 is pivoted upward about the axis through bracket 12. In the upward position, indicated by broken lines in FIG. 2, lid L can be removed and refuse can be deposited into the container. Additionally, when refuse collectors desire to dump the contents of container C into a pickup container, the container can be freely handled because when support 14 is pivoted to the upper broken line position it is totally disengaged from the container. As seen in FIG. 2, the pivot axis through bracket 12 is spaced from base plate 16 by a distance greater than the length of legs 28*a* and 28*b* so that container support 14 can be pivoted clear of the container and the lid.

Figure 3:
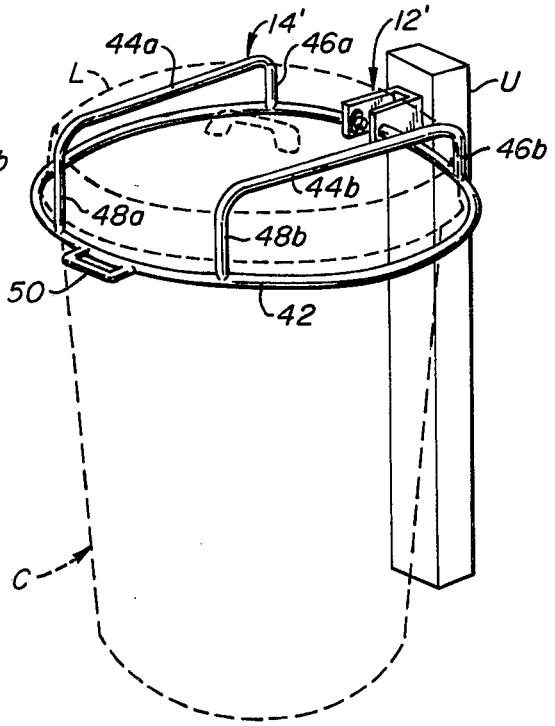
FIG. 3 is a view similar to FIG. 1 showing a modification of the invention.
Figure 4:
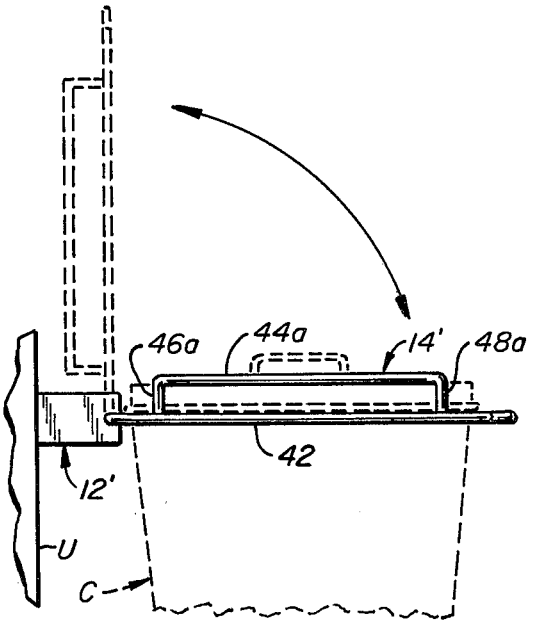
FIG. 4 is a side view of the modification shown in FIG. 3.

A modification of the invention is shown in FIGS. 4 and 5. It will be noted that the modification is similar in many respects to the embodiment described hereinabove in connection with FIGS. 1, 2 and 5. In FIGS. 3 and 4 there is a bracket 12' which is identical in all material respects to bracket 12 previously described. Pivotally mounted to the bracket is a container support 14' which includes a loop 42 which has end portions similar to those seen in FIG. 5 for supporting a loop for pivotal movement on a horizontal axis through the side plates of bracket 12'. In the example seen in FIG. 3, loop 42 is of circular shape. Loop 42 has a diameter greater than container C and lid L so that it can reside in the horizontal position seen in FIG. 4. Because loop 42 circumscribes container C, portions of the loop constitute container confining portions substantially equivalent to those indicated in FIG. 1 at 26*a*, 26*b* and 38. Extending upward from loop 42 at oppositely located regions thereof are inverted U-shaped members constituted respectively by a lid retainer 44*a* having legs 46*a* and 48*a* depending from opposite ends thereof and a lid retainer 44*b* having legs 46*b* and 48*b* depending from opposite ends thereof. Lid retainers 44*a* and 44*b* are parallel to one another and extend chordally of the circular configuration of loop 42.

The lower ends of legs 46*a*, 48*a*, 46*b* and 48*b*, i.e., the ends remote from the respective lid retainers, are welded or otherwise rigidly affixed to ring 42 such that when the lid retainers rest on the top of lid L, loop 42 is below rim R of the container so as to confine the container and lid against lateral movement. Finally, a U-shaped handle 50 is fixed by welding or the like to loop 42 at a location diametrically opposite bracket 12'.

Operation and use of the embodiment described above in conjunction with FIGS. 3 and 4 is substantially identical to operation of the embodiment of FIGS. 1 and 2. Although the embodiment of FIGS. 3 and 4 requires additional manufacturing steps such as welding of the parts together, it is heavier than the embodiment of FIGS. 1 and 2 and therefore is somewhat more secure against large animals.

Both embodiments of the invention function to confine container C against lateral movement and retain lid L in place. These salutary functions are provided without requiring any modification of or attachment to container C or lid L. Accordingly, removal of the container when its contents must be dumped in a larger pickup container can be accomplished efficiently, and container C and the lid can be quickly replaced if such becomes necessary.

Although two embodiments of the invention have been shown and described, it will be obvious that other adaptations and modifications can be made without departing from the true spirit and scope of the invention.

What is claimed is:

1. Apparatus for supporting a refuse container adjacent an upright wherein the container is of the type including a wall having a rim that defines an opening affording access to the interior of the container and a removable lid for covering the opening, the lid having a centrally disposed handle, said apparatus comprising a bracket adapted for installation on the upright at a level approximating that of the rim and a rigid unitary container support mounted to said bracket for pivotal movement about a horizontal axis, said support having confining portions shaped and sized to at least partially circumscribe the container wall below the rim, said confining portion being in approximate conformity with said wall for laterally confining said container at opposite regions of said wall, at least two lid retainers rigid with said confining portions, said lid retainers being disposed between said confining portions and flanking a region midway between said confining portions so as to avoid interference with the lid handle, each said lid retainer including an inverted U-shaped member having a central lid engaging portion and first and second legs depending from opposite ends of the central portion, said legs having ends remote from respective said central lid engaging portions that are rigidly joined to said confining portions so that said central lid engaging portions engage said lid and said confining portions circumscribe said container below said rim in response to gravitational force from the weight of said container support about said axis, said container support being pivotally movable to a substantially upright position to permit removal of said lid.

2. Apparatus according to claim 1 wherein said container support is formed from a unitary length of relatively thin rigid material, there being junctures between said confining portions, said legs and said lid engaging portions formed by bends in said material.

3. Apparatus according to claim 2 wherein said confining portions are formed at a first location astraddle said bracket and at a second location opposite said first location, and wherein said lid engaging portions extend between said confining portions in spaced apart relation and in mutual parallelism and substantially perpendicular to said axis.

4. Apparatus according to claim 3 wherein said confining portions are arcuately configured and lie in an imaginary circle, and wherein said lid engaging portions extend chordally of the imaginary circle.

5. Apparatus according to claim 3 wherein a medial portion of said confining portion at said second location includes an outward projecting handle for affording a hand grip on said container support to facilitate pivotal movement thereof.

6. Apparatus according to claim 1 wherein said container support includes a loop formed of relatively thin rigid material sized and shaped to circumscribe the container below said rim, portions of said loop constituting said confining portions.

7. Apparatus according to claim 6 wherein said loop is of generally circular shape and wherein said lid retainers extend chordally of said circular shape.

8. Apparatus according to claim 7 wherein said lid retainers are spaced apart in mutually parallel and are substantially perpendicular to said pivot axis.

* * * * *